US008984771B1

(12) United States Patent
Kramer

(10) Patent No.: US 8,984,771 B1
(45) Date of Patent: Mar. 24, 2015

(54) CUSHIONING SOLE FOR FOOTWEAR

(71) Applicant: Hyman Kramer, Bronx, NY (US)

(72) Inventor: Hyman Kramer, Bronx, NY (US)

( * ) Notice: Subject to any disclaimer, the term of this patent is extended or adjusted under 35 U.S.C. 154(b) by 0 days.

(21) Appl. No.: 14/334,278

(22) Filed: Jul. 17, 2014

(30) Foreign Application Priority Data

Apr. 10, 2014 (CN) ..... 2014 1 0141084

(51) Int. Cl.
*A43B 13/18* (2006.01)
*A43B 13/00* (2006.01)
*A43B 13/14* (2006.01)

(52) U.S. Cl.
CPC ..... *A43B 13/18* (2013.01); *A43B 13/00* (2013.01); *A43B 13/14* (2013.01)
USPC ..... 36/28

(58) Field of Classification Search
CPC ..... A43B 13/18; A43B 13/184
USPC ..... 36/25 R, 28, 34 R, 35 R, 61
See application file for complete search history.

(56) References Cited

U.S. PATENT DOCUMENTS

| | | | | | |
|---|---|---|---|---|---|
| 1,165,235 | A | | 12/1915 | Emery | |
| RE20,381 | E | * | 5/1937 | Murray | 36/35 R |
| 2,350,362 | A | * | 6/1944 | Margolin | 36/3 B |
| 2,423,753 | A | * | 7/1947 | Brooks | 36/35 R |
| 2,540,449 | A | * | 2/1951 | Kaufmann | 36/24.5 |
| 2,648,916 | A | * | 8/1953 | Greissinger | 36/149 |
| 2,844,833 | A | | 7/1958 | Odermatt | |
| 2,863,230 | A | * | 12/1958 | Cortina | 36/29 |
| 3,267,592 | A | * | 8/1966 | Champion | 36/35 R |
| 4,887,367 | A | | 12/1989 | Macness et al. | |
| 5,367,791 | A | * | 11/1994 | Gross et al. | 36/31 |
| 5,493,791 | A | | 2/1996 | Kramer | |
| 5,775,005 | A | * | 7/1998 | McClelland | 36/31 |
| 5,860,229 | A | | 1/1999 | Morgenstern | |
| 6,205,684 | B1 | | 3/2001 | Snyder | |
| 6,874,251 | B2 | | 4/2005 | Moretti | |
| 7,000,334 | B2 | | 2/2006 | Gillespie | |
| 7,200,955 | B2 | * | 4/2007 | Foxen | 36/25 R |
| 8,220,182 | B2 | * | 7/2012 | Righetto | 36/28 |
| 8,607,475 | B2 | * | 12/2013 | Nakano | 36/37 |
| 2003/0061733 | A1 | | 4/2003 | Karsten | |
| 2006/0117603 | A1 | | 6/2006 | Park | |
| 2007/0277401 | A1 | * | 12/2007 | Young-Chul | 36/30 R |
| 2008/0313924 | A1 | * | 12/2008 | Righetto | 36/28 |
| 2010/0139120 | A1 | | 6/2010 | Manz et al. | |
| 2011/0225842 | A1 | * | 9/2011 | Lu | 36/27 |
| 2012/0055048 | A1 | * | 3/2012 | Haupt et al. | 36/34 R |
| 2012/0085002 | A1 | * | 4/2012 | Healy et al. | 36/34 R |
| 2014/0082972 | A1 | * | 3/2014 | Jones | 36/34 R |

OTHER PUBLICATIONS

International Search Report and Written Opinion for Application No. PCT/US14/47081 mailed Nov. 21, 2014.

* cited by examiner

*Primary Examiner* — Marie Bays
(74) *Attorney, Agent, or Firm* — Merchant & Gould PC

(57) ABSTRACT

A cushioning sole for footwear includes a heel portion, an opening, and a cushioning slide. The heel portion includes a top surface and a bottom surface. The opening extends vertically through the heel portion from the bottom surface to the top surface. The cushioning slide is disposed in the opening and extends out from the top surface and out from the bottom surface.

17 Claims, 2 Drawing Sheets

CUSHIONING SOLE FOR FOOTWEAR

CROSS-REFERENCE TO RELATED APPLICATION

This application claims benefit of Serial No. 201410141084.0, filed on Apr. 10, 2014 in China, titled CUSHIONING SOLE FOR FOOTWEAR. To the extent appropriate, a claim of priority is made to the above-disclosed application. Also, to the extent appropriate, the above-disclosed application is hereby incorporated by reference in its entirety.

BACKGROUND

Gait varies from person to person depending on the biomechanical characteristics or other factors. FIG. 1 shows three typical manners in which the foot contacts the ground, from left to right, pronated, neutral/normal, and supinated. Briefly, in pronation the foot takes on a position in which most of the body weight is loaded onto the inner edge of the foot. On the contrary, in supination the foot takes on a position in which the body weight is loaded onto the outer edge of the foot.

From the biomechanical viewpoint, it is correct to rest the foot on the ground in the neutral manner. Excessive pronation or supination is the source of many lower extremity problems, including muscle tiredness, knee joint pain, tendinitis, ligament strain, and even neurological damage.

SUMMARY

The present disclosure relates to correction of excessive pronation/supination. Some embodiments provide a cushioning sole which can be used in any kind of footwear. The sole comprises a heel portion having an opening for receiving a support element in a manner that the heel portion will not touch the ground until the support element is compressed.

In one embodiment, a cushioning slide, made of a durable material, is inserted in the opening and extends a distance beyond the top surface and the bottom surface of the heel portion, so as to withstand the pressure of the body when walking and running.

In another embodiment, two cushioning slides are arranged in the opening and are separated by a flexible substrate.

In an alternate embodiment, the cushioning slide can be made with open ends such that it can be filled with a flexible material.

DETAILED DESCRIPTION

Figure 1:
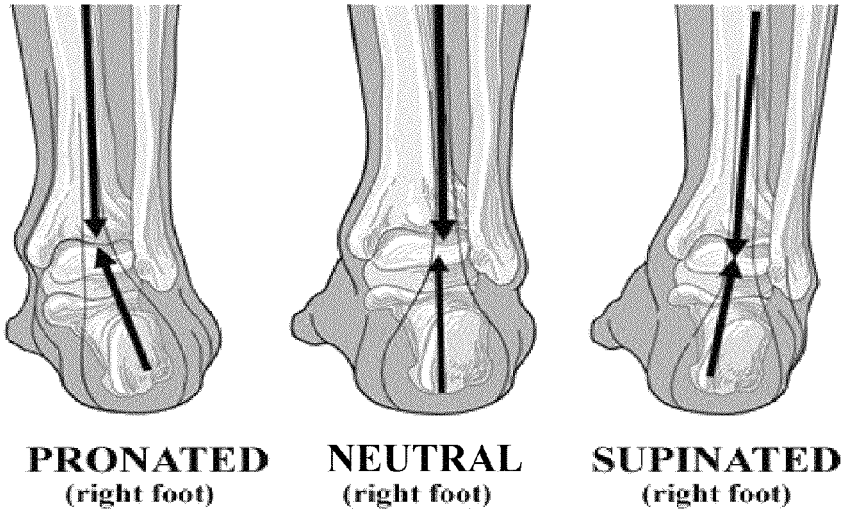
FIG. 1 is an illustrative example of a foot in pronated, neutral, and supinated positions.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is an illustrative example of a foot in pronated, neutral, and supinated positions. In pronation the foot takes on a position in which most of the body weight is loaded onto the inner edge of the foot. On the contrary, in supination the foot takes on a position in which the body weight is loaded onto the outer edge of the foot. In a neutral position the body weight is distributed more evenly across the entire bottom of the foot.

Figure 2:
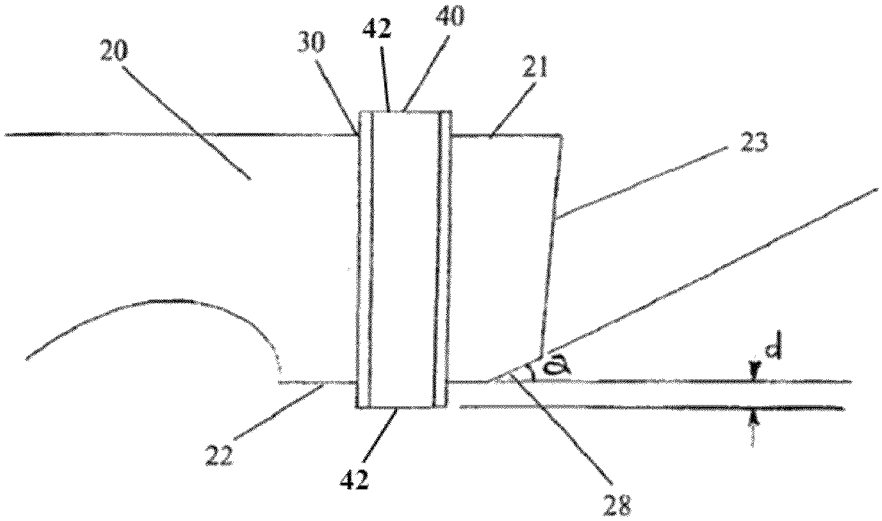
FIG. 2 illustrates a side view of the heel portion of the sole.

FIG. 2 illustrates a side view of the heel portion 20 of the sole of one embodiment of the present disclosure. In one embodiment, the sole comprises a heel portion 20 in which an opening 30 is formed, preferably at the center of the heel portion 20. A cushioning slide 40 is inserted in the opening 30 in a manner that the slide extends a distance beyond the bottom 22 and top 21 surfaces of the heel portion 20. In a preferred embodiment, during walking, the extended cushioning slide 40 always contacts the ground first. The sole bottom 22 begins to contact the ground only after the cushioning slide 40 has been compressed. In this way, flexible material is allowed to be used in footwear while retaining stability and durability of the sole. The cushioning slide 40, when contacting the ground and being compressed, changes the downward pressure applied by the wearer's weight to upward pressure which assists in walking and running. More importantly, the cushioning slide 40 ensures the foot always contacts the ground at the correct location, thereby resisting pronation/supination.

A person having excessive pronation/supination problem repeatedly puts his/her body weight on a side of the foot. As a result, the periphery of the heel portion 20 of the sole wears out quickly, causing a more severe problem. In preferred embodiments, to avoid this, the heel section 28 is formed at an angle $\alpha$ in the periphery of the heel portion 20 with respect to its bottom surface 22. It is desirable to incorporate an angle $\alpha$ in the whole back 23 lower end of the heel portion 20. The angle $\alpha$ is an angle greater than 0 degrees and less than 90 degrees. In some embodiments the angle $\alpha$ is in a range from about 10 degrees to about 60 degrees. In other embodiments the angle $\alpha$ is in a range from about 20 degrees to about 50 degrees.

In alternative embodiments, the heel lacks a support element and does not contain an opening for receiving that element. In these embodiments, the sole still contains the heel section 28 formed at an angle $\alpha$ in the periphery of the heel portion 20 with respect to its bottom surface 22. Without wishing to be bound to any particular theory, it is believed that heel section 28 can correct excessive pronation/supination problem all by itself, and that a support element, e.g., cushioning slide 40, is optional.

The distance d of the cushioning slide 40 beyond the bottom 22 surface of the heel portion 20 should be within a suitable range. If the distance d is too small, the cushioning slide 40 may not be able to separate the heel portion 20 of the sole from the ground after a long period of walking. If the distance d is too large, the wearer may experience an uncomfortable feeling. In one embodiment, the distance d is in a range from about 1/16 inch and 1/4 inch, or about 1/8 inch to retain the cushioning slide's 40 function for a long period without causing an uncomfortable feeling.

The cushioning slide 40 in some embodiments is made of plastic, rubber or other cushioning materials. The cushioning slide 40 can be formed into different shapes, which can include, but are not limited to, a cylinder, prism or cone. The example shown in FIG. 2 includes a cylindrically shaped cushioning slide. Other embodiments include, for example, rectangular or elliptical cross-sectional shapes. The opening 30 typically has a cross-sectional shape that matches the cross-sectional shape of the cushioning slide 40. In some embodiments corners and edges are rounded to reduce pressure points and to reduce the chance of catching on another object.

In some embodiments, the cushioning slide 40 is slideably retained in the heel portion 20 and is not permanently secured to the heel portion 20. In this way the cushioning slide is slidable within the opening 30 and can be replaced when worn out. Additionally, in some embodiments the cushioning slide 40 can be made with open ends 42 so that it can be filled with a flexible material to absorb shock in a more efficient way.

As can be seen from FIG. 2, the upper end of the cushioning slide 40 also extends beyond the top surface 21 of the heel portion 20. The resistant force of the compressed cushioning slide 40 acts on the wearer's heel, helping the wearer to walk easily.

Figure 3:
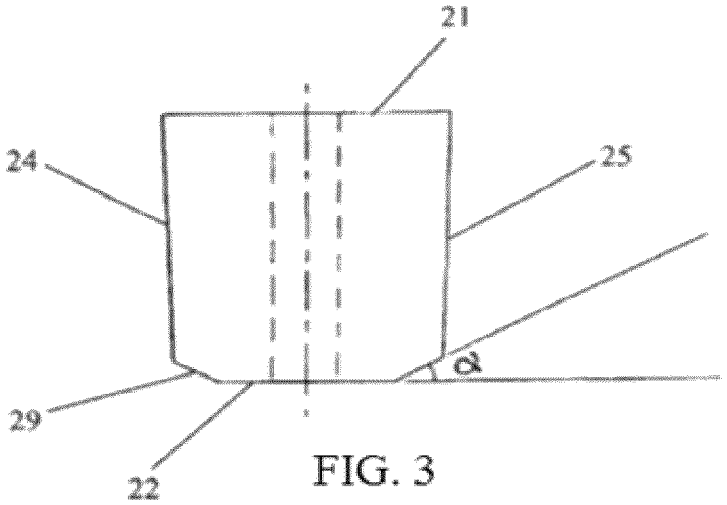
FIG. 3 is a rear view of the sole.

FIG. 3 is a rear view of the sole. In some embodiments, the left rear wall 24 and the right rear wall 25 of the heel portion 20 are also angled with an angle $\alpha$ in a tapered configuration with respect to the bottom 22 surface to avoid wear of the sole. In one embodiment, the tapered configuration 29 is applied around the whole bottom 22 heel portion 20 of the sole, including the front portion, so that the edges of the footwear do not touch the ground. In other embodiments, the tapered configuration is applied to whole bottom 22 heel portion 20 of the sole and also to the front portion of the sole.

Figure 4:
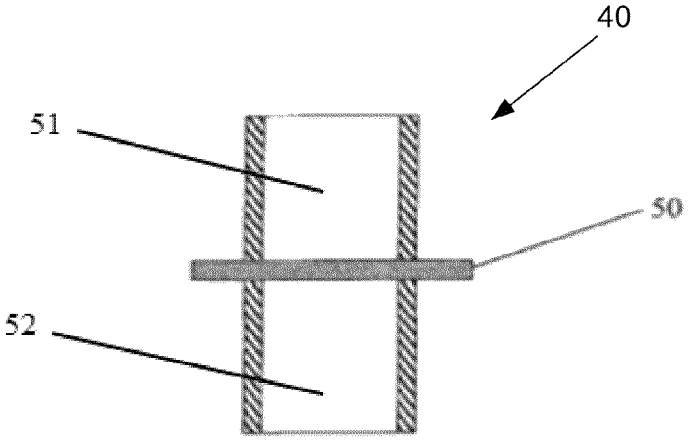
FIG. 4 is a cross section view of a cushioning slide, comprising an upper part and a lower part connected by a strip.

FIG. 4 is a cross section view of one embodiment of the cushioning slide 40, comprising an upper slide portion 51 and a lower slide portion 52 connected by a substrate. In this example, the substrate is a strip 50. In some embodiments, the strip 50 has at least one cross-sectional dimension greater than the upper slide portion 51 and the lower slide portion 52 extending into sides of the opening. The strip 50 is used to support the cushioning slide 40 and prevent it from moving. In some embodiments the upper slide portion 51 and the lower slide portion 52 are formed of a cushioning material, while the strip 50 is formed of either a cushioning material or a rigid material. In other embodiments, the upper slide portion 51 and the lower slide portion 52 are formed of a rigid material, while the strip 50 is formed of a cushioning material to provide the cushioning for the cushioning slide. The cushioning material is at least a material with greater flexibility than the rigid material.

Figure 5:
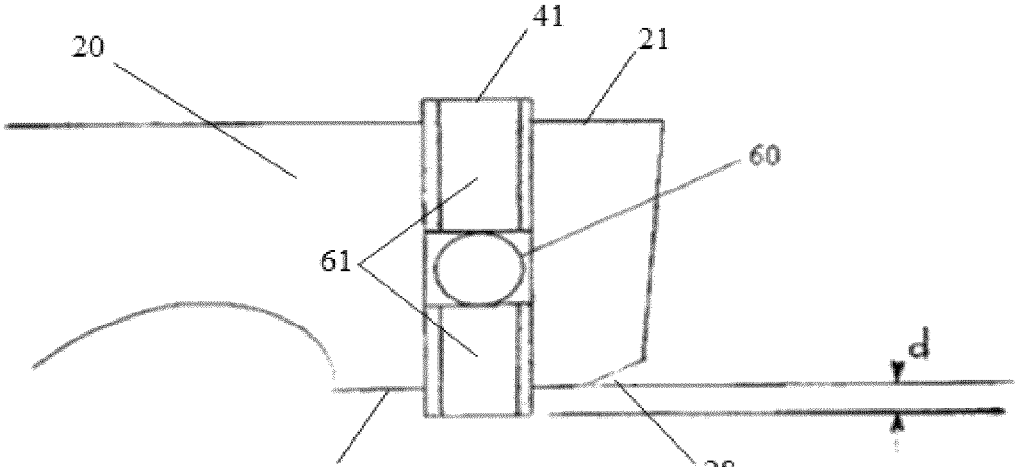
FIG. 5 illustrates a side view of the heel portion of the sole according to another embodiment of the present disclosure.

FIG. 5 is a side view of another embodiment of the present disclosure. The cushioning slide 41 comprises two slide portions 61 separated by a substrate 60. In some embodiments, the substrate 60 is a flexible substrate. The upper and lower slides 61 respectively extend beyond the top surface 21 and the bottom surface 22 of the heel portion 20. The physical property of the flexible substrate 60 can be adjusted according to different ground conditions. The use of flexible substrate 60 increases the compact resistance in a controlled way and further stabilizes the foot.

Some embodiments include a plurality of flexible substrates having different flexibilities. Also, in some embodiments at least one of the upper and lower portions are removable. The flexible substrates are replaceable within the opening to permit selective insertion of a flexible substrate having a desired flexibility according to the conditions or preferences of the wearer.

The distance d of the cushioning slide 41 beyond the bottom 22 surface of the heel portion 20 should be within a suitable range. If the distance d is too small, the cushioning slide 41 may not be able to separate the heel portion 20 of the sole from the ground after a long period of walk. If the distance d is too large, the wearer may experience an uncomfortable feeling. In one embodiment, the distance d is in a range from about 1/16 inch and 1/4 inch, or about 1/8 inch to retain the cushioning slide's 41 function for a long period without causing an uncomfortable feeling.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A cushioning sole for footwear, the cushioning sole comprising:

a heel portion having a top surface and a bottom surface;

an opening extending vertically through the heel portion from the bottom surface to the top surface; and a cushioning slide disposed in the opening and extending out from the top surface and the bottom surface, wherein the cushioning slide comprises an upper portion extending through the top surface; a bottom portion extending through the bottom surface; and a substrate disposed in the opening between the upper portion and the bottom portion, wherein the substrate has greater flexibility than the upper portion and the lower portion, and wherein the upper portion and the lower portion have greater rigidity than the substrate.

2. The cushioning sole of claim 1, wherein the cushioning slide extends from the bottom surface such that the heel portion will not touch ground until the cushioning slide is compressed.

3. The cushioning sole of claim 1, wherein when the cushioning slide is worn by a person for one of walking and running, the cushioning slide extends from the bottom surface such that the heel portion will not touch ground until the cushioning slide is compressed.

4. The cushioning sole of claim 1, wherein at least a portion of the cushioning slide is slidably retained within the opening.

5. The cushioning sole of claim 1, wherein a lower end of a back edge of the heel portion is tapered at an angle with respect to a bottom surface of the heel portion.

6. The cushioning sole of claim 5, wherein a periphery of the heel portion is tapered at the angle with respect to a bottom surface of the heel portion.

7. The cushioning sole of claim 6, wherein the angle is greater than 0 degrees and less than 90 degrees.

8. The cushioning sole of claim 6, wherein the angle is in a range from 10 degrees to about 60 degrees.

9. The cushioning sole of claim 6, wherein the angle is in a range from about 20 degrees to about 50 degrees.

10. The cushioning sole of claim 1, wherein the cushioning slide extends a distance in a range from 1/16 inch to 1/4 inch beyond the top surface and the bottom surface of the heel portion.

11. The cushioning sole of claim 10, wherein the distance is about 1/8 inch.

12. The cushioning sole of claim 10, wherein the distance is 1/8 inch.

13. The cushioning sole of claim 1, wherein the substrate is a strip configured to retain the cushioning slide within the opening.

14. The cushioning sole of claim 1, further comprising a plurality of flexible substrates having different flexibilities, wherein the at least one of the upper and lower portions are removable, and wherein the flexible substrates are replaceable within the opening to permit selective insertion of a flexible substrate having a desired flexibility.

15. The cushioning sole of claim 1, wherein the cushioning slide has one or more open ends that are filled with a flexible material.

16. A sole for footwear, the sole comprising:

a heel portion having a top surface and a bottom surface, wherein a periphery of the heel portion, including at least side edges and a rear edge, is tapered at an angle with respect to a bottom surface of the heel portion;

an opening extending vertically through the heel portion from the bottom surface to the top surface; and a cushioning slide disposed in the opening and extending out from the top surface and the bottom surface, wherein the cushioning slide comprises an upper portion extending through the top surface; a bottom portion extending through the bottom surface; and a substrate disposed in the opening between the upper portion and the bottom portion, wherein the substrate has greater flexibility than the upper portion and the lower portion, and wherein the upper portion and the lower portion have greater rigidity than the substrate.

17. The sole of claim 16, wherein the angle is in a range from 10 degrees to about 60 degrees.

* * * * *